US009222333B2

(12) United States Patent
Hoffman et al.

(10) Patent No.: US 9,222,333 B2
(45) Date of Patent: Dec. 29, 2015

(54) MONITORING SYSTEM FOR BOREHOLE OPERATIONS

(71) Applicants: Joshua Hoffman, Tomball, TX (US); Edward O'Malley, Houston, TX (US); Charles Johnson, League City, TX (US)

(72) Inventors: Joshua Hoffman, Tomball, TX (US); Edward O'Malley, Houston, TX (US); Charles Johnson, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 161 days.

(21) Appl. No.: 13/685,978

(22) Filed: Nov. 27, 2012

(65) Prior Publication Data

US 2014/0144224 A1 May 29, 2014

(51) Int. Cl.

| | |
|---|---|
| ***E21B 49/08*** | (2006.01) |
| ***E21B 33/134*** | (2006.01) |
| ***E21B 47/01*** | (2012.01) |
| ***E21B 47/06*** | (2012.01) |

(52) U.S. Cl.

CPC ..... *E21B 33/134* (2013.01); *E21B 47/011* (2013.01); *E21B 47/06* (2013.01)

(58) Field of Classification Search

CPC ..... E21B 49/084; E21B 33/12–33/12955; E21B 13/134; E21B 47/01; E21B 47/011; E21B 47/06; E21B 47/065; E21B 49/08–49/10

USPC ..... 73/152.18, 152.23, 152.26, 152.28, 73/152.36

See application file for complete search history.

(56) References Cited

U.S. PATENT DOCUMENTS

| | | | | |
|---|---|---|---|---|
| 6,131,658 | A * | 10/2000 | Minear | 166/250.01 |
| 6,234,257 | B1 * | 5/2001 | Ciglenec et al. | 175/50 |
| 6,360,823 | B1 * | 3/2002 | Ranson et al. | 166/381 |
| 6,634,425 | B2 * | 10/2003 | King et al. | 166/253.1 |
| 6,758,274 | B2 * | 7/2004 | Parent et al. | 166/264 |
| 6,766,854 | B2 * | 7/2004 | Ciglenec et al. | 166/250.11 |
| 7,918,282 | B2 * | 4/2011 | Heller et al. | 166/313 |
| 8,113,044 | B2 * | 2/2012 | Montaron et al. | 73/152.51 |
| 2004/0207539 | A1 * | 10/2004 | Schultz et al. | 340/854.3 |
| 2005/0056418 | A1 * | 3/2005 | Nguyen | 166/250.1 |
| 2006/0005965 | A1 * | 1/2006 | Chouzenoux et al. | 166/250.11 |
| 2006/0219401 | A1 * | 10/2006 | Longfield et al. | 166/250.1 |
| 2006/0243434 | A1 * | 11/2006 | Sharp et al. | 166/125 |
| 2008/0115934 | A1 * | 5/2008 | Pettinato et al. | 166/254.1 |
| 2009/0044949 | A1 * | 2/2009 | King et al. | 166/332.4 |
| 2010/0071896 | A1 * | 3/2010 | Christie et al. | 166/250.01 |
| 2010/0257926 | A1 * | 10/2010 | Yamate et al. | 73/152.23 |
| 2011/0094741 | A1 * | 4/2011 | Vigneaux et al. | 166/282 |
| 2011/0219866 | A1 * | 9/2011 | Brower | 73/152.31 |

(Continued)

OTHER PUBLICATIONS

Weatherford, [online]; [retrieved Jan. 31, 2013]; retrieved from the Internet http://www.ep-weatherford.com/PDF/Literature/L_Permanent_Downhole_Monitoring_A4.pdf "Permanent Downhole Monitoring," © 2006 Weatherford, 16p.

(Continued)

*Primary Examiner* — Peter Macchiarolo
*Assistant Examiner* — Natalie Huls
(74) *Attorney, Agent, or Firm* — Cantor Colburn LLP

(57) ABSTRACT

An assembly for monitoring a fluid operation including a plug member operatively arranged to impede fluid flow past the plug when the plug member is engaged with a seat. A conveyor is coupled to the plug and operatively arranged for positioning the plug at a desired location. A signal conductor is disposed with the conveyor. At least one sensor is coupled with the signal conductor for monitoring one or more parameters related to the fluid operation. A method of monitoring a fluid operation is also included.

21 Claims, 1 Drawing Sheet

(56) References Cited

U.S. PATENT DOCUMENTS

| | | | | |
|---|---|---|---|---|
| 2012/0118583 | A1* | 5/2012 | Johnson et al. | 166/376 |
| 2013/0043041 | A1* | 2/2013 | McCoy et al. | 166/373 |
| 2014/0014339 | A1* | 1/2014 | O'Malley et al. | 166/281 |
| 2014/0048251 | A1* | 2/2014 | King et al. | 166/120 |
| 2014/0048252 | A1* | 2/2014 | King et al. | 166/135 |
| 2014/0124214 | A1* | 5/2014 | Mailand et al. | 166/376 |

OTHER PUBLICATIONS

International Search Report and Written Opinion for PCT Application No. PCT/US2013/066570, dated Jan. 27, 2014, pp. 1-14.

* cited by examiner

MONITORING SYSTEM FOR BOREHOLE OPERATIONS

BACKGROUND

The downhole drilling and completions industry utilizes a variety of sensors and intelligent devices for monitoring various parameters during the performance of borehole operations. Many such operations include the pumping and control of fluids and are monitored to determine the effectiveness and/or efficiency of the operations. In hydraulic fracturing, for example, a fluid or slurry is pumped at high pressure to fracture a downhole formation, namely in order to produce hydrocarbons therefrom. The measurement of parameters such as temperature, pressure, acoustics, etc. can be useful to operators not only to evaluate or aid in performing a given operation, but also to enable operators to establish best practices for performing future operations based on past results. However, it is costly and time consuming to run the equipment necessary to monitor the performance of borehole operations. Furthermore, the sensors and data or signal lines are often run exterior to a tubular string, or in some other location prone to damage during run-in. Even after run-in, it is believed that vibrations in the tubular string, e.g., during a hydraulic fracturing process, can damage fiber optic and other cables coupled to the tubular string. In view of the foregoing it can be appreciated that the industry always well receives advances and alternatives in systems for monitoring downhole operations.

SUMMARY

An assembly for monitoring a fluid operation including a plug member operatively arranged to impede fluid flow past the plug when the plug member is engaged with a seat; a conveyor coupled to the plug and operatively arranged for positioning the plug at a desired location; a signal conductor disposed with the conveyor; and at least one sensor coupled with the signal conductor for monitoring one or more parameters related to the fluid operation.

A method of monitoring a fluid operation, including positioning a monitoring assembly within a tubular string with a conveyor of the monitoring assembly; engaging a plug member of the monitoring assembly with a seat of the tubular string in order to impede fluid flow through the seat; monitoring a fluid operation performed at least partially through the tubular string with a sensor of the monitoring assembly while the plug member is engaged with the seat; and conducting a signal to or from the sensor via a signal conductor disposed with the conveyor.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
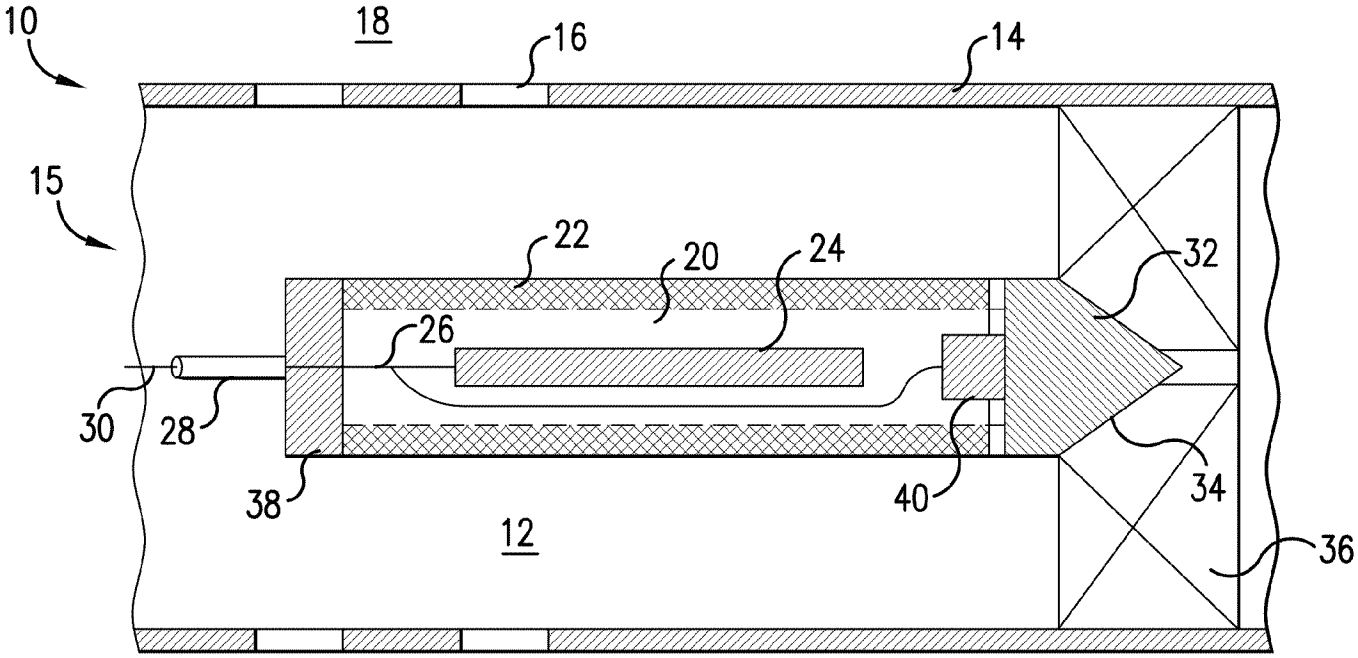
FIG. 1 is a schematic view of a monitoring system according to one embodiment disclosed herein.

Referring now to FIG. 1, a system 10 is illustrated for monitoring a borehole operation involving fluid flow control, pressurization, etc. In the illustrated embodiment, fluid is pumped through an inner passageway 12 of a tubular string 14 and monitored by a monitoring assembly 15. The string 14 could be or define a cased or lined borehole, or some other tubular or completion assembly. The string 14 includes a plurality of openings 16 for enabling communication between the inner passageway 12 and a formation 18 (or zone, reservoir, etc.) proximate to the string 14. The openings 16 can be formed and/or opened in any desired manner and axially spaced from the assembly 15 any desired distance. In one embodiment, the openings 16 are formed by triggering the charges of one or more perforation guns lowered into the string 14 (e.g., according to known plug-and-perf techniques). In another embodiment, the openings 16 are preformed ports in the tubular string 14 that are arranged with a shifting sleeve or other valve that is selectively openable via a tool, hydraulic pressure, electric charge, etc. Other openings may alternatively or additionally be utilized as desired for each particular application.

In one embodiment, the operation that is monitored by the assembly 15 involves hydraulic fracturing of the formation 18 or some other fluid treatment. In a fracturing operation, information regarding the fracturing can be gleaned by measuring various parameters, such as acoustics, pressure, temperature, etc. As is generally known, these and other parameters can be useful to operators in performing an operation as well as determining the effectiveness and efficiency of the processes once completed. This information is also useful in devising and evolving best practices in performing such operations by comparing the results of past operations. It is of course to be recognized that other downhole operations involving the flow or control of fluid could be monitored by the system 10, e.g., circulation, treatment, pressurization, hydraulic actuation, etc. Furthermore, it is to be understood that the term "fluid" as used herein refers to any material or media that flows, which may partially or entirely comprise solid particles, e.g., a proppant slurry.

The assembly 15 includes a body 20. The body 20 includes a fluid permeable cover or housing 22 surrounding a sensor or intelligent device 24 mounted therein. The purpose of the housing 22 is to generally protect the sensor 24 while enabling fluid communication therewith from the inner passageway 12, e.g., for the aforementioned monitoring of pressure, temperature, and other parameters. To this end, the outer jacket 22 could be any assembly used in screening applications, such as a perforated tubular, fluid permeable foam, mesh, wire wrap, etc. In this way, the sensor can be protected from any solids in a fluid flow, e.g., proppant, while monitoring the fluid. In one embodiment the sensor 24 takes the form of a gauge commercially available from Baker Hughes Inc. under the trade name SureSENS, although it is to be appreciated that other sensors and devices capable of monitoring desired parameters could alternatively or additionally be used.

In order to communicate the measurements taken by the sensor 24 to operators at surface, a signal conduction line or signal conductor 26 is included. In the illustrated embodiment, the signal conductor is part of or is disposed with a wireline 28 for enabling the communication of electronic, power, and data signals to and from the sensor 24. In one embodiment, a fiber optic line 30 is included and integrated or coupled with the wireline 28. Since the fiber optic line 30 is a signal conductor, it be used as or in lieu of the signal conductor 26. Furthermore, in one embodiment, the fiber optic line 30 includes fiber Bragg gratings, or utilizes some other sensing feature for enabling an optical fiber line to sense parameters such as temperature, pressure, acoustics, etc. In this way, the fiber Bragg gratings or other sensing features in the optic fiber line 30 could be used as, in lieu of, or additionally with, the sensor 24. That is, fiber Bragg gratings or the like could be the sole sensing devices utilized in the system 10, or could be used in addition to a separate gauge or sensor. The use of fiber Bragg gratings or other features of the fiber optic line 30 enables, for example, distributed sensing of one or more parameters along a length of the string 14. The use of a designated gauge, sensor, or intelligent device in the body 20 enables high-resolution, real-time monitoring of the desired parameters. It is to be appreciated that combinations of the above will of course enable each of the above discussed advantages.

Regardless of the particular signal conductors and/or sensors used, integration with the wireline 28 provides protection during run-in. For example, the wireline 28 forms a protective casing or sheath for the signal conductor 26 and/or fiber optic line 30. Also, due at least in part to its positioning at the center of the tubular string 24, there is little risk of the wireline 28 harshly contacting or becoming pinched or crimped by other components in the tubular string 28, particularly with respect to some prior systems in which fiber optic or other lines are run-in exteriorly on tubulars.

Figure 2:
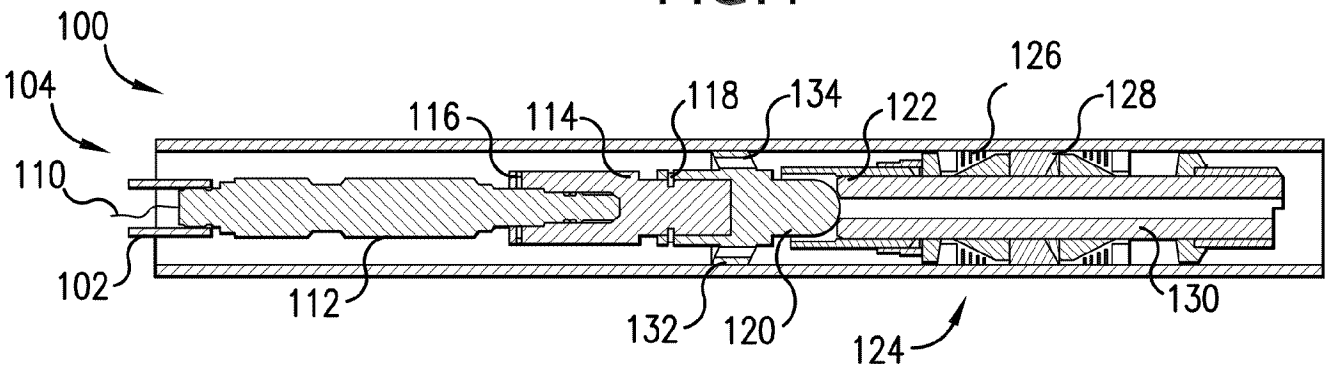
FIG. 2 is a cross-sectional view of a monitoring system according to another embodiment disclosed herein.

The body 20, opposite the wireline 28, terminates in a nose or plug member 32. The plug member 32 of the body 20 is arranged to be sealingly received in a seat 34 of a plug assembly 36 located within the string 14. In one embodiment, the plug assembly 36 is a so-called frac plug assembly used in a plug and perf operation, in which a ball or plug is dropped from surface and received at the seat. Of course, instead of dropping a ball or plug, the plug member 32 is conveyed to the seat 34 via the wireline 28 (or some other conveyor, as discussed below). The assembly 36 may include slips, anchors, seals, packers, or any other components necessary for its intended use, and may be drillable, dissolvable, retrievable, etc. A more detailed example of a plug assembly is shown in FIG. 2 that may include a seat for engagement with the plug member 32. The seat 34 could also be secured to or coupled with the tubular string 14 in other ways.

The purpose of the plug member 32 is to enable isolation in the inner passageway 12 of the string 14 after receipt with a suitable seat member, e.g., the seat 24. By impeding fluid flow past the plug member 32, fluid pumped down the inner passageway is instead able to be pressurized and/or directed out through the openings 16 and into the formation 18, thereby enabling fracturing or some other fluid treatment operation to be performed. The plug member also acts to stabilize and support the monitoring assembly 15 during the monitoring process, as opposed to having the assembly 15 hang freely from the wireline 28. As previously noted, vibrations of tubular strings during processes such as hydraulic fracturing can cause damage to signal conductors, particularly fiber optic lines, which are relatively brittle. However, the signal conductor 26 and/or fiber optic line 30 are relatively isolated or sheltered from such vibrations by suspended in the fluid as opposed to connected to the tubular string 14 or some other component directly connected thereto. That is, while some vibration from the string 14 may be transferred to the assembly 15 via the engagement between the plug member 32 and the seat 34, the signal conductor 26 and/or fiber optic line 30 are relatively unaffected due to their suspension in the fluid and indirect relationship to the string 14.

In the illustrated embodiment, the assembly 15 is conveyed downhole by the wireline 28. In other embodiments, conveyance could be accomplished in some other manner. For example, a system 100 illustrated in FIG. 2 includes a coiled tubing string 102 as a conveyor for positioning a monitoring assembly 104 within a tubular string 106. The coiled tubing string 102 may be particularly useful in embodiments in which the assembly 104 is to be positioned in a horizontal or deviated section of a borehole.

Similar to the assembly 15 of the system 10, the assembly 104 includes a signal conductor 110 disposed within the coiled tubing string 102. The signal conductor 110 could be a fiber optic line, electric signal and/or power line, etc., or combinations thereof, as discussed above. The signal conductor 110 could be embedded or disposed in or through walls of the coiled tubing 102, attached to an interior wall of the coiled tubing 102, loosely disposed within the coiled tubing 102, etc. Thus, the signal conductor 110 is protected by the coiled tubing similar to the signal conductor 26 and/or optic fiber 30 in the system 10.

The signal conductor 110 is arranged with suitable sensors, which can be housed in a sensor body 112 (e.g., a designated gauge), included along a length of the signal conductor 110 (e.g., fiber Bragg gratings), or combinations thereof. The body 112 may generally resembles the body 20 discussed above, e.g., having a fluid permeable housing that protects one or more sensors. The bodies 20 and 112 can be made to be adaptable in order to accommodate the use with various conveyors, e.g., both wireline and coiled tubing. For example, an adapter cap 38 is shown in the embodiment of FIG. 1 coupled between the wireline 28 and the body 20. The cap 38 is releasably securable to at least one of the wireline 28 (or other conveyor, e.g., the coiled tubing 102) and the body 20 (or the body 112). For example, the cap 38 could be threadingly engaged, force fit, secured by screws or other fasteners, etc. By releasing the cap 38 from the body 20 and/or the wireline 28, a new assembly can be attached to the wireline 28 or the assembly 15 attached to a new conveyor, (e.g., a different wireline, coiled tubing, etc.).

The body 112 is optionally coupled with an extender 114. As discussed in more detail below, the extender 114 can be arranged as a sacrificial component that is destroyed, removed, or left downhole in order to facilitate retrieval of the remainder of the assembly 104, as discussed in more detail below. In the illustrated embodiment, for example, a plurality of shear screws 116 releasably connect the body 112 and the extender 114 together. Other release members could be included, such as one-way or two-way ratcheting, magnetic coupling, lock rings, shear rings, etc. By severing the connection between the body 112 and the extender 114, the bulk of the assembly 104 can be retrieved even if the extender 114 becomes stuck, e.g., by solids in a pressurized fluid slurry packing in around the extender 114 after completion of the fluid operation that is monitored.

The seal extender 114 is in turn coupled via a plurality of fasteners 118 to a plug member 120. The fasteners 118 could be shear screws or other release members, although this may be redundant if the shear screws 116 or some other release member is included between the body 112 and the extender 114. The plug member 120 is arranged to be received at a seat 122 in order to isolate opposite sides of the plug member 122 within the tubular 106 from each other. One potential feature of the extender 114 is to space the body 112, containing the aforementioned gauges, sensors, etc., a known distance from the plug member 120 and the seat 122. For example, in plug and perf operations it is typically desired to position the perforation guns some minimum distance from the subsequently lower zone. By use of the extender 114, the body 112 and its associated sensors can be positioned proximate to perforations or other openings in the tubular string 106 (e.g., as discussed with respect to the openings 16).

The seat 122 is formed as part of a plug assembly 124, e.g., which may be referred to in the art as a frac plug assembly as previously noted. In the illustrated embodiment, the plug assembly 120 includes slips 126 or another anchoring device to anchor the assembly 120 within the tubular 106, and a packer or seal element 128 to provide isolation exterior to the seat 122 and a passageway 130 formed therethrough that is blocked by the plug member 120 when engaged. It is to of course be appreciated that other downhole structures, including ball seats, packers, seal profiles, anchors, nipples, and/or plug assemblies could be used in lieu of those shown. As with the assembly 36, the assembly 124 could be drillable, retrievable, disintegrable, or otherwise removable, e.g., to enabling production of hydrocarbons or the like through the tubular string 104.

In the embodiment of FIG. 2, the plug member 120 includes a flange or centralizer 132 to stabilize the monitoring assembly 104 during run-in and monitoring. The flange 132 also centers the plug member 120 so that it is properly aligned with the seat 122 for engagement with the seat 122. Additionally, the flange 132 creates additional surface area for aiding in the ability to pump the assembly 104 downhole in a fluid stream. It is noted that since the conveyance of tools via wireline relies upon the weight of the tool for advancement through a well, the flange may be necessary for wireline systems, e.g., the system 10, deployed into horizontal or deviated boreholes. A number of passages 134 are formed through the flange to facilitate the plug member 120 being run-in through fluid and to prevent the undesired over-pressurization of fluid on the leading side of the flange 132 as it progresses through the tubular string 106.

The assemblies 15 and/or 104 may be arranged with a feature that facilitates retrieval of the assemblies. By this it is meant that the monitoring assemblies are operatively arranged with a feature to enable, allow, permit, or aid in the retrieval of at least a portion of the assemblies. By retrieving the wireline, coiled tubing, signal conductors, sensors, sensor body, etc., all or a significant portion of the monitoring assembly can be reused for another job, re-run for a new zone in the same borehole, recycled for another use, etc. thereby saving time and equipment costs. In one embodiment, retrieval is facilitated by detaching the plug member (e.g., plug members 32 or 120) from its respective body (e.g., bodies 20 and 112). Detachment of the plug member may be most effective for retrieval in embodiments in which the plug member has a flange, centralizer, or other features that extend radially outwardly of the body 20, such as the flange 132 in the embodiment of FIG. 2. The plug member may also be detachable in instances in which continued isolation at the seat is desired even after the remainder of the monitoring assembly is retrieved.

Detachability of the plug member is achieved in another embodiment by disintegrating, dissolving, consuming, decomposing, corroding, degrading, or otherwise causing removal of the plug member or some portion of the assembly. In one embodiment, the plug member or a portion of the assembly is made from so-called controlled electrolytic metallic (CEM) materials in order to enable the plug member to disintegrate upon exposure to desired fluids (e.g., water, brine, acid, or combinations thereof), which may be the same fluids monitored by the monitoring assembly. For example, the plug members 32 and/or 120, extender 114, shear screws 116, fasteners 118, etc., portions thereof, or any other member or feature connecting the plug members to the rest of the monitoring assembly could be made from disintegrable materials.

In one embodiment, as shown in FIG. 1, the line 26 extends to a retrieval facilitating device 40, enabling power thereto. The device 40 could be any device that would aid in the detachment of the plug member 32 or retrieval of the assembly 15. In one embodiment, the device 40 is a pump that provides a jet or stream of fluid about the body 20 and the plug member 32, e.g., through the permeable housing 22 or outlets in the housing 22, the body 20, or the plug member 32, in order to disturb any solids that have packed in about the assembly 15, e.g., proppant or other particles, in order to dislodge and reduce friction on the assembly 15 as it is pulled out. Multiple pumps or outlets for the jet of fluid may be located along the length of the body. In another embodiment, the device 40 is an actuator for a lock device that selectively couples the body 20 and the plug member 32 together, e.g., a retractable/extendable pin that engages in a corresponding slot of the other member.

One of ordinary skill in the art will appreciate that combinations of the various features of the systems 10 and 100 and other modifications could be made in order to form new embodiments, which are all within the intended scope of the current claims. Also, it is to be noted that multiple assemblies according to the current invention could be run in succession in order to monitoring the fracturing, treatment, etc. of multiple zones along the length of the tubular string. In fact, it will be appreciated that the current invention monitoring assemblies can be utilized essentially in place of drop balls in known fluid operations. That is, one can perform essentially all of the same steps currently used in plug and perf or other fluid operations but instead of dropping a ball or plug to enable isolation at a corresponding seat or plug assembly, one would instead run in a current invention monitoring assembly. Advantageously, this enables the use of the current invention assemblies with existing equipment and largely according to existing procedures, if so desired, although these monitoring assemblies could of course be used in other systems or according to other methods. As one example, openings in a first zone could be opened according to known procedures, e.g., via perforations guns or by actuating corresponding valve assemblies. Thereafter, a monitoring assembly could be run-in to isolate the first zone for the treatment, fracturing, or other fluid operation. After the fluid operation is monitored and completed, the assembly can be retrieved, as noted above. Retrieval of the assembly may include leaving the plug members 32 and/or 120, the extender 114, etc. in the borehole as discussed above. If the first plug member is destroyed or left downhole, a new plug can be added to the retrieved assembly so that the assembly can be run-in for a new zone. Of course, generally according to known procedures, a frac plug or other seat assembly may need to be placed above the first zone and openings formed in the new zone before the next zone is be treated. This process can be repeated as needed to fracture or treat any number of zones in a well.

It is also noted that some currently used fracture systems do not use individually settable frac plugs or perforation guns. Instead, these systems may use a plurality of seats of different sizes that are run-in with the tubular string, arranged from smallest at a bottom zone of the borehole to largest at the top, and each associated with a hydraulically activated sleeve or valve for opening corresponding ports for each zone. By dropping successively larger balls or plugs, the smaller plugs will pass through the larger seats such that each successive zone can be isolated from the lower zones. The actuatable sleeves or valves can be triggered for opening a new set of ports after each ball is dropped. The current invention monitoring assemblies can be used also with this type of system by increasing the size of each new plug member that is added to the monitoring assembly between runs. For example, this could be accomplished by attaching a larger sized plug member to the assembly each time the assembly is retrieved, particularly if the plug member is detached or disintegrated downhole to facilitate retrieval of the assembly. As another example, the assembly could be decoupled from the wireline, coiled tubing, or other conveyor, e.g., via the adapter cap 38, and then another assembly having a larger plug member attached to the conveyor. As yet another example, the seats within the completion system could be configured to be addressable by the deployed plug and/or monitoring assembly, so that the assembly will only seat in the desired location on any given run (e.g. counter mechanisms, RFID tags and readers, etc.).

An example of a CEM material that is suitable for this purpose is commercially available from Baker Hughes Inc. under the trade name IN-TALLIC®. A description of suitable materials can also be found in United States Patent Publication No. 2011/0135953 (Xu et al.), which Patent Publication is hereby incorporated by reference in its entirety. These lightweight, high-strength and selectably and controllably degradable materials include fully-dense, sintered powder compacts formed from coated powder materials that include various lightweight particle cores and core materials having various single layer and multilayer nanoscale coatings. These powder compacts are made from coated metallic powders that include various electrochemically-active (e.g., having relatively higher standard oxidation potentials) lightweight, high-strength particle cores and core materials, such as electrochemically active metals, that are dispersed within a cellular nanomatrix formed from the various nanoscale metallic coating layers of metallic coating materials, and are particularly useful in borehole applications. Suitable core materials include electrochemically active metals having a standard oxidation potential greater than or equal to that of Zn, including as Mg, Al, Mn or Zn or alloys or combinations thereof. For example, tertiary Mg—Al—X alloys may include, by weight, up to about 85% Mg, up to about 15% Al and up to about 5% X, where X is another material. The core material may also include a rare earth element such as Sc, Y, La, Ce, Pr, Nd or Er, or a combination of rare earth elements. In other embodiments, the materials could include other metals having a standard oxidation potential less than that of Zn. Also, suitable non-metallic materials include ceramics, glasses (e.g., hollow glass microspheres), carbon, or a combination thereof. In one embodiment, the material has a substantially uniform average thickness between dispersed particles of about 50 nm to about 5000 nm. In one embodiment, the coating layers are formed from Al, Ni, W or $Al_2O_3$, or combinations thereof. In one embodiment, the coating is a multilayer coating, for example, comprising a first Al layer, an $Al_2O_3$ layer, and a second Al layer. In some embodiments, the coating may have a thickness of about 25 nm to about 2500 nm. These powder compacts provide a unique and advantageous combination of mechanical strength properties, such as compression and shear strength, low density and selectable and controllable corrosion properties, particularly rapid and controlled dissolution in various borehole fluids. The fluids may include any number of ionic fluids or highly polar fluids, such as those that contain various chlorides. Examples include fluids comprising potassium chloride (KCl), hydrochloric acid (HCl), calcium chloride ($CaCl_2$), calcium bromide ($CaBr_2$) or zinc bromide ($ZnBr_2$).

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. An assembly for monitoring a fluid operation, comprising:

a plug member operatively arranged to impede fluid flow past the plug member when the plug member is engaged with a seat;

a conveyor coupled to the plug member and operatively arranged for positioning the plug member at a desired location;

a signal conductor disposed with the conveyor;

at least one sensor arranged within a fluid permeable body coupled to the plug member and coupled with the signal conductor for monitoring one or more parameters related to the fluid operation; and a retrieval device configured and disposed to deliver a flow stream of fluid about the plug member.

2. The assembly of claim 1, wherein the plug member is configured and disposed to separate from the conveyor.

3. The assembly of claim 1, wherein the plug member is at least partially formed from a material disintegrable upon exposure to a selected fluid.

4. The assembly of claim 3, wherein the material is a controlled electrolytic metallic material.

5. The assembly of claim 1, wherein the plug member is coupled to the conveyor via one or more release members.

6. The assembly of claim 1, wherein the signal conductor includes a fiber optic line.

7. The assembly of claim 6, wherein the sensor includes at least one fiber Bragg grating formed in the fiber optic line.

8. The assembly of claim 1, wherein the conveyor includes a wireline.

9. The assembly of claim 8, wherein the signal conductor is integrated with the wireline.

10. The assembly of claim 1, wherein the conveyor includes a coiled tubing string.

11. The assembly of claim 1, wherein the sensor is a gauge for measuring temperature, pressure, acoustics, or a combination including at least one of the foregoing.

12. A system including the assembly of claim 1 and a tubular string, the assembly positioned within an inner passageway of the tubular string, and the plug member of the assembly engaged with a corresponding seat coupled with the tubular string.

13. The system of claim 12, wherein the tubular string includes at least one opening for providing fluid communication between the inner passageway and a formation proximate to the at least one opening.

14. The system of claim 13, wherein the fluid operation is a fracturing operation or a fluid treatment operation performed on the formation.

15. A method of monitoring a fluid operation, comprising:

positioning a monitoring assembly within a tubular string with a conveyor of the monitoring assembly;

engaging a plug member of the monitoring assembly with a seat of the tubular string in order to impede fluid flow through the seat;

monitoring a fluid operation performed at least partially through the tubular string with a sensor of the monitoring assembly while the plug member is engaged with the seat, the sensor being arranged in a fluid permeable body coupled to the plug;

conducting a signal to or from the sensor via a signal conductor disposed with the conveyor; and delivering a flow stream of fluid about the plug member from a retrieval device.

16. The method of claim 15, further comprising retrieving at least a portion of the monitoring assembly.

17. The method of claim 16, wherein retrieving including decoupling the plug member from the monitoring assembly.

18. The method of claim 17, wherein decoupling includes disintegrating the plug member or a component coupling the plug member to the monitoring assembly.

19. The method of claim 16, further comprising re-positioning the monitoring assembly and re-monitoring a new fluid operation in a new zone of the tubular string.

20. The method of claim 19, further comprising attaching a new plug member to the monitoring assembly before re-positioning the monitoring assembly, the new plug member operatively arranged to engage a different seat in the tubular string associated with the new zone.

21. The method of claim 15, wherein the fluid operation is a hydraulic fracture or a fluid treatment operations.

* * * * *